United States Patent [19]

Theilacker

[11] 4,393,773

[45] Jul. 19, 1983

[54] ROTARY SHEET PRINTING MACHINE WITH TRANSPORT CHAIN

[75] Inventor: Klaus Theilacker, Friedberg, Fed. Rep. of Germany

[73] Assignee: M.A.N.-Roland Druckmaschinen Aktiengesellschaft, Offenbach Am Main, Fed. Rep. of Germany

[21] Appl. No.: 360,067

[22] Filed: Mar. 22, 1982

[30] Foreign Application Priority Data

Apr. 8, 1981 [DE] Fed. Rep. of Germany ..... 3114076

[51] Int. Cl.[3] ..... B41F 21/06

[52] U.S. Cl. ..... 101/232; 271/264

[58] Field of Search ..... 101/232, 237, 238, 246, 101/408, 409, 183–185; 271/264, 268, 277, 247

[56] References Cited

U.S. PATENT DOCUMENTS

| | | | |
|---|---|---|---|
| 3,935,814 | 2/1976 | Weisgerber | 101/232 |
| 3,972,413 | 8/1976 | Simeth | 101/232 X |
| 3,999,480 | 12/1976 | Yamamoto | 101/232 X |
| 4,222,326 | 9/1980 | Mathes et al. | 101/232 |

FOREIGN PATENT DOCUMENTS

| | | | |
|---|---|---|---|
| 2259050 | 7/1973 | Fed. Rep. of Germany | 101/232 |
| 1261665 | 1/1972 | United Kingdom | 101/232 |

*Primary Examiner*—E. H. Eickholt

*Attorney, Agent, or Firm*—Frishauf, Holtz, Goodman & Woodward

[57] ABSTRACT

To permit application of a liquid, such as a lacquer, an ink dryer, or a coloring or area inking liquid to a sheet of paper being transported from a printing machine by a conveyor chain (6), a liquid application cylinder (14) is positioned between the upper (5) and lower (4) run of the chain. To accommodate the grippers (7, 13) and still permit application of a selected liquid to the liquid application cylinder, the liquid application cylinder is formed with a groove (15) deep enough to entirely receive the gripper structure (7, 13) therein and guide rails or tracks (17, 19; 18, 20) are provided, guiding the grippers such that a sheet is moved in contact with the circumference of the application cylinder by guiding the engagement surface of the grippers tangentially with respect to its circumference, and guiding the return run of the chain such that the grippers are wholly received within the groove to permit supply of the roller by a liquid transport or supply roller (22) and provide for clearance of the grippers and gripper structure with respect to that transport or supply roller and prevent damage thereto. A counter roller which operates in the form of a printing or impression cylinder may be provided, in engagement with the ink application cylinder, the counter cylinder (26), for example, forming a rubber blanket cylinder of another offset printing system (28, 30).

15 Claims, 5 Drawing Figures

ROTARY SHEET PRINTING MACHINE WITH TRANSPORT CHAIN

The present invention relates to rotary sheet printing machines and more particularly to machines of this type which utilize a transport chain to transport sheets between the printing system of the machine and a delivery station which, for example, may be a stacking apparatus, or some other type of machine or apparatus, in which the machine carries grippers to hold the sheets.

BACKGROUND

Printing machines using transport chains are known; see, for example, German Patent Disclosure Document DE-OS No. 30 15 519. The printing machine there shown has an endless chain transport conveyor and a cylinder located between the supply and return runs. This printing cylinder is formed with a rubber surface, that is, as a rubber cylinder and a plate cylinder in engagement with the printing cylinder, which further includes an inker and a damper. Theoretically, the possibility arises to use such a printing system to apply lacquer, or other coatings, or impression printing, or to apply with such a cylinder a liquid which prevents smear of ink, for example by setting or hardening printing ink applied on the upper side of a printed sheet. It is not necessary to construct a complete offset printing system if it is only required to apply a liquid, such as lacquer or other coating to the sheet. Simplification of the system, however, is difficult, since the gripper elements which transport the sheet, can fit within the groove of the blanket cylinder only to the extent of tangential relationship of the gripper surfaces with respect to the circumference of the rubber cylinder.

The grippers, customarily, are carried by a cross bar which extends between two chains forming the transport conveyor, one at either axial end of the cylinders. If the gripper cross bar engages deeper into the groove of the cylinder the sheet is bent about the edge of the groove and may be creased thereby; further, registration difficulties and alignment difficulties may result. An impression, or partial coating of the sheet thus would not occur at the proper position thereof. The required position of the gripper cross piece can be obtained by suitable dimensioning of the groove. In the position in which the gripper surfaces which actually grip the sheet are tangent with the circumference of the cylinder, results, however, in components of the gripper to extend over the outer circumference thereof. This occurs in the forward run as well as in the reverse run of the conveyor chain. If another printing cylinder is located at the sides of the rubber blanket cylinders which are engaged by the transport chain, then no difficulties will result since the printing cylinders, themselves, also have grooves which can receive the projecting portions of the gripper structure attached to the chain. It is not, however, possible to apply application rollers rather than a plate cylinder which has grooves, for example application rollers of diameter which is different, typically smaller than the blanket cylinder there against, since danger would result that such application rollers collide with projecting portions of the gripper structure.

The machine, thus, is generally directed to a printed machine system which has transport chains, typically two chains, one at each axial end of the respective printing cylinders with cross elements or cross braces which carry the gripper structures themselves, and which convey sheets from a printing station to another apparatus, for example a stacking apparatus. The return run of the chain runs freely, that is, empty. Apparatus is provided to apply a liquid at least to the upper side of the sheet being conveyed by the chain, which includes, for example, an application roller running against the blanket cylinder which has a groove capable of receiving the gripper structures, including, for example, the cross pieces or cross elements connecting the chains and holding the grippers themselves.

THE INVENTION

It is an object to simplify a printing machine which permits application of a liquid to one side of the sheet and still permit use of a transport chain system.

Briefly, the rubber blanket cylinder has an axial groove which is dimensioned to receive the entirety of the grippers of the transport chain and, if provided, cross pieces or cross elements connecting two transport chains at the respective axial ends of the cylinders. Chain guide means are provided which guide the supply run of the chains around the liquid application cylinder, typically a rubber blanket cylinder, such that the gripping surfaces of the grippers are tangent to the liquid application cylinder; additional chain guide means are provided to guide the return run of the chain to locate the grippers entirely within the groove of the liquid application, or rubber blanket cylinder. By receiving the grippers on the return run wholly within the groove, further liquid transport rollers can be brought in rolling contact with the surface of the liquid application roller without fear of damage thereto when the grippers of the transport chain pass beneath the liquid transport rollers.

The present invention has the advantage that the cylinder which is adjacent the return run of the transport chain no longer needs to have a groove; rather, instead of such a grooved, or special cylinder simple liquid transport rollers or solid surface rollers of various types may be used.

DRAWINGS

Figure 4:
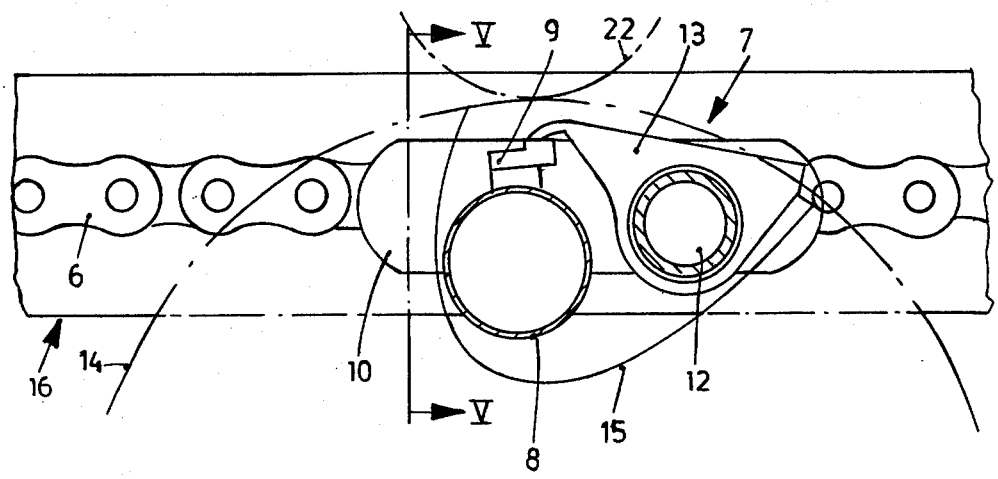
FIG. 4 is a view similar to FIG. 2 but taken with respect to the return run of the transport chain.
Figure 5:
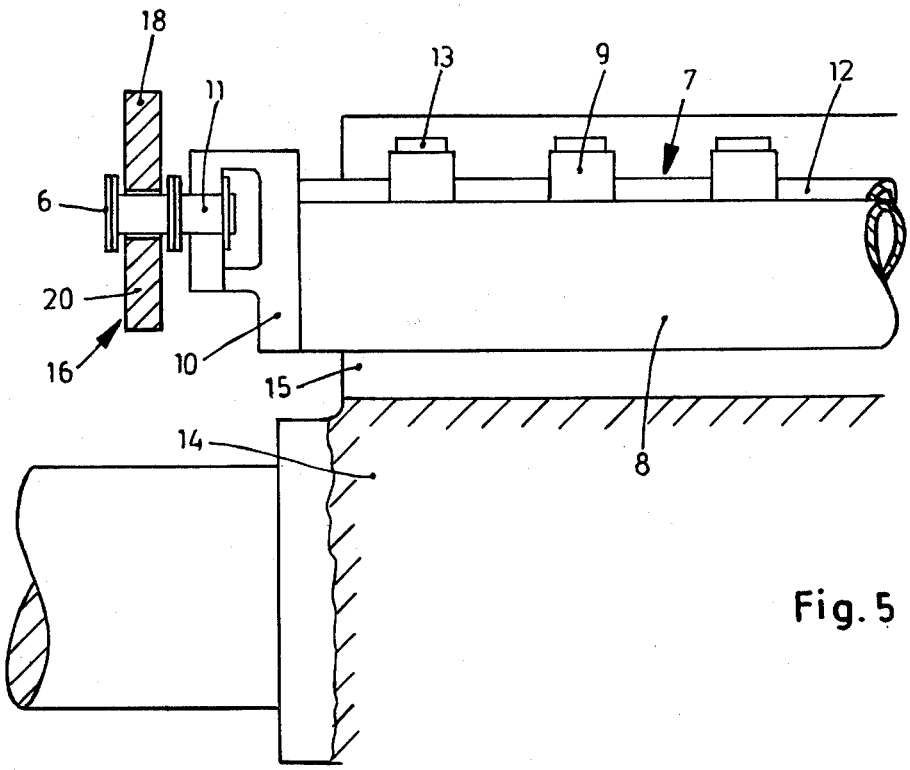

and FIG. 5 is a fragmentary cross section or view along line V—V of FIG. 4.

Figure 1:
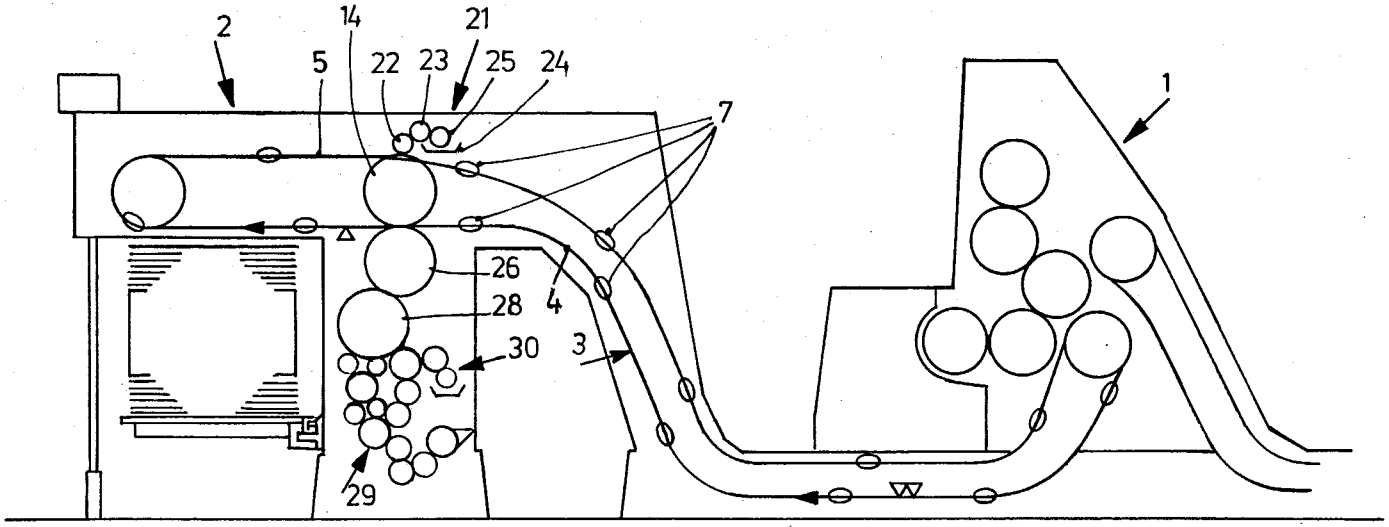
FIG. 1 is a schematic side view of a rotary printing machine utilizing the present invention.

The printing machine 1 of FIG. 1 is shown, generally, as a sheet rotary offset printing machine and may be of any suitable and well known construction. Sheets are supplied by a transport conveyor chain system 3 to a sheet stacking apparatus 2.

The supply or forwardly moving run 4 of the transport chain system 3 picks up printed sheets from the printing station 1 to supply them to the stacking device 2 which, generally, may be any type of delivery system. The return run 5 of the transport chain system 6 runs empty from the stacking device 2, back to the printing station 1.

The transport chain system 3 includes two chains 6 of which only one is visible in the drawings. The two chains 6 are guided about the axial ends of one of the cylinders of the printing station 1. Cross elements 7, to hold grippers, are located between the chains 6. Each one of the gripper cross elements 7 has a support tube 8 with gripper engagement surfaces 9 thereon, secured at the respective ends to a bracket 10. Each bracket 10 is journaled on a pin 11 of the chain 6. A gripper spindle 12 is further located between the brackets 10. The gripper spindle 12 carries a plurality of grippers 13 (see FIG. 3). Other types of gripper structures may be used, the particular gripper structure here being shown forming a preferred embodiment.

Figure 3:
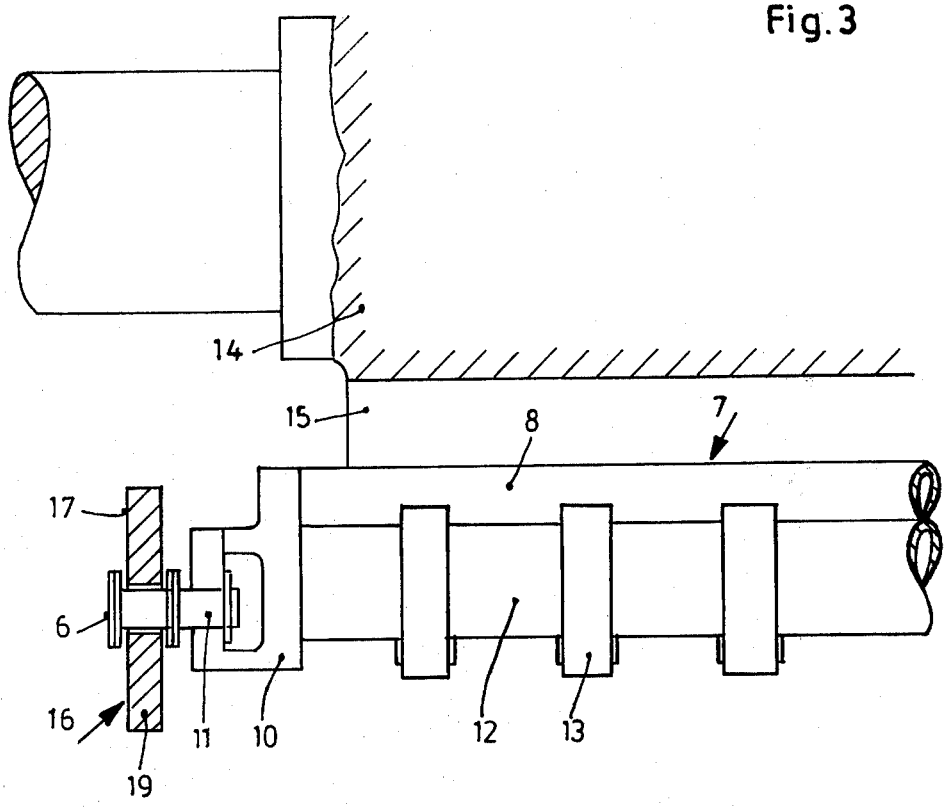
FIG. 3 is a fragmentary cross section along line III—III of FIG. 2.

A cylinder 14 with a groove 15 therein is located between the forward or supply run 4 and a return run 5 of the transport chain system 3. The cylinder 14 is positioned in advance of the inlet to the stacking apparatus 2. The chain 6 is guided in chain guides 16, at least within the range of the cylinder 14. The chain guide 16 has upper and lower tracks 17, 19 (FIG. 3) for the supply run and upper and lower tracks or guide elements 18, 20 (FIG. 5) for the return run of the chain. The chain 6 is guided between the respective runs 17, 19; 18, 20, as seen in FIGS. 3 and 5. A liquid transport or supply roller 22 is positioned above the cylinder 14 and thus above the return run 5 of the transport chain system 3. The transport or supply roller 22 is so located that it can engage the surface of the cylinder 14. It is in contact with a further transport roller 23 which, for example, may be a milling roller and which receives liquid from the liquid trough 24 via a ductor, or other transfer roller 25. Rollers 22–25 and the trough 24 form a liquid supply system. Liquid is transferred by the liquid transport roller 22 to the cylinder 14 for transfer to a sheet which is gripped in the grippers of the cross element 7 of the supply run 4 of the transport chain system 3. Cylinder 14 has a rubber blanket thereover, or a rubber surface. Cylinder 14, together with the roller 22, 23, 25, and the trough 24 cooperate and form the overall liquid application system 21. A further cylinder 26 is located beneath cylinder 14, similarly to a printing, or impression cylinder for cylinder 14 and forming a counter element therefor.

Figure 2:
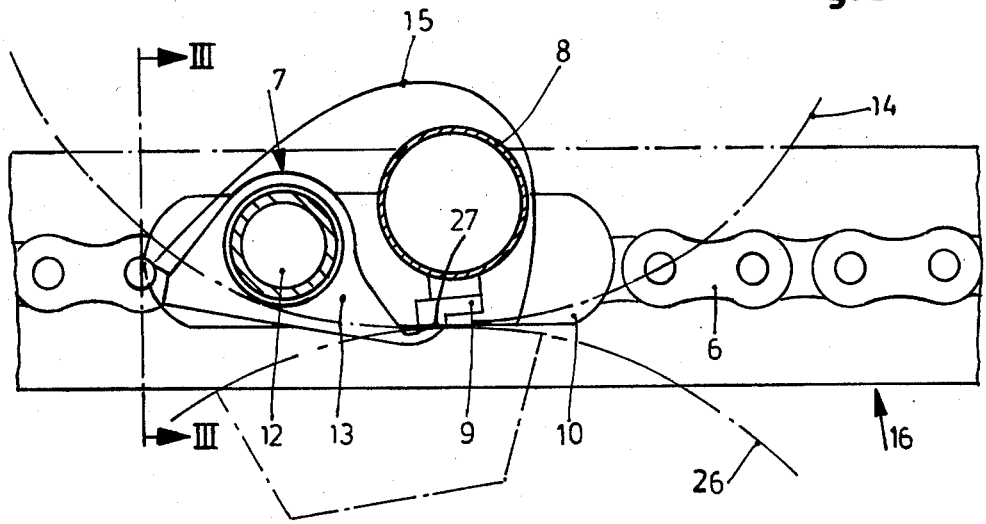
FIG. 2 is a cross sectional view to a greatly enlarged scale through a gripper cross element illustrating the supply run of the supply chain, within the region of the application cylinder.

The chain guide 16 which controls the supply run 4 of the transport chain system 3 is so located with respect to cylinder 14—see FIGS. 2 and 3—that the gripper engagement surface 27 of the gripper engagement element 9 is tangential with respect to the circumference of the cylinder 14 as the chain runs past the cylinder. This tangential engagement is arranged to occur at the position or line of engagement between the cylinder 26 and the cylinder 14. A sheet, held by the grippers 13 on the respective surface 27 thus is pulled through the printing line between the cylinders 14 and 26 in a straight line, transverse to the printing line. The chain guide 16 for the return run 5, however, is differently located. As seen in FIGS. 4 and 5, the chain guide elements 18, 20 so guide the return run that the entire gripper system, including the cross element 7, fits within the groove 15 of the cylinder 14. Thus, gripper 13 is clear of the surface of the liquid transport or supply roller 22.

In the embodiment shown, cylinder 26 likewise carries a rubber coating or rubber blanket. It is in engagement with a plate cylinder 28 which has an inker 29 and a damper 30 associated therewith.

Liquid application system 21 thus can be used to provide a coating, lacquer coating or other coating liquid to the prime printing or upper side of the sheet being transported by the transport chain system 3. At the same time, the printing system by the cylinder 26 and the inkers and dampers 29, 30 in combination with the plate cylinder 28, permit application of verso printing at the lower side of the sheet.

The invention, of course, is not limited to applying verso printing to the lower side of the sheet; it is not necessary to provide a second printing system in engagement with cylinder 26. The lacquer or liquid application system only requires some counter support, for example, the cylinder 26, acting similar to an impression or printing cylinder.

Cylinder 14 need not have a rubber blanket or rubber surface. It may have a flexible plate applied thereto. It is then possible to apply only partial lacquer coating or other liquid coating by the system 21.

It is further possible to apply ink or eye of a predetermined color on raised portions of a flexible plate applied to the cylinder 14 so that a portion or impression can be applied to the prime printing side of the sheet.

Various types of liquids may be used in the trough 24 for application by the system 21; for example, a liquid which prevents smear or run of the freshly printed ink may be used therein. Such liquids, for example, are kerosene, or other hydrocarbons, or aqueous alcohol solutions.

Various changes and modifications may be made within the scope of the inventive concept.

I claim:

1. Rotary sheet printing machine having a printing station (1) and a receiving station (2);

a transport chain system (3) to transport sheets from the printing station to the receiving station including an endless transport chain (6) forming a supply run (4) and a return run (5) and having grippers (13) located thereon;

means (21) applying a liquid to at least the upper side of the sheet being transported by the chain system including a liquid application cylinder (14) located between the supply run and the return run of the chain formed with an axial groove (15) in its circumference, and a counter cylinder (26) located for surface engagement with the liquid application cylinder opposite the supply run of the chain wherein, in accordance with the invention the axial groove in the liquid application cylinder (14) is dimensioned to receive the entirety of the grippers (13) of the transport chain (6);

supply chain guide means (17, 19) are provided guiding the chain with respect to the liquid application cylinder such that a gripping surface (9, 27) of the grippers is tangent to the liquid application cylinder;

and return chain guide means (18, 20) are provided guiding the chain with respect to the liquid application cylinder such that the grippers (13) are wholly received in the groove (15) to permit application of a liquid to the liquid application cylinder at the side thereof engaged by the return run of the chain.

2. Printing machine according to claim 1, wherein the supply run (4) of the chain passes adjacent the bottom of the circumference of the liquid application cylinder, and the return run (5) of the chain passes adjacent the top of the liquid application cylinder.

3. Printing machine according to claim 1, further including a liquid transport or supply roller (22) engageable with the surface of the liquid application cylinder (14) at the side thereof engaged by the return run (5) of the chain;

and means (23, 24, 25) furnishing a liquid to said liquid transport or supply roller.

4. Printing machine according to claim 3, wherein said liquid furnishing means includes a further liquid supply roller (23);

a liquid supply trough (24);

and a pick-up roller (25) at least partly dipping into said trough and transferring liquid to the further liquid supply roller (23).

5. Printing machine according to claim 1, wherein said liquid application cylinder (14) has a rubber blanket surface.

6. Printing machine according to claim 1, wherein said liquid application cylinder (14) has a flexible printing plate secured thereto.

7. Printing machine according to claim 1, wherein the counter cylinder (26) comprises a rubber blanket cylinder (26);

and an offset printing system (28, 29, 30) is provided including a plate cylinder (28) in engagement with the rubber blanket cylinder (26).

8. Printing machine according to claim 1, wherein at least one of said chain guide means comprises tracks or rails (17, 19; 18, 20) located spaced from each other, the chain (6) of the transport chain system being guided between the spaced tracks or rails.

9. Printing machine according to claim 1, wherein the transport chain system comprises two chains located at respective axial ends of the liquid application cylinder (14);

and cross elements (7) secured to the chains and carrying the grippers (13)).

10. Printing machine according to claim 9, including support brackets (10) supporting said cross elements;

said pivotable connection means (11) connecting the support brackets to the chains.

11. Printing machine according to claim 1, further including liquid supply and furnishing means (21; 22, 23, 24, 25) including a supply element (22) in surface engagement with said liquid application cylinder at the side thereof engaged by the return run (5) of the chain.

12. Printing machine according to claim 11, further including in the liquid supply and furnishing means whereby said furnishing means in combination with the liquid application cylinder form a lacquer station.

13. Printing machine according to claim 11, further including an ink or coloring liquid in said liquid furnishing means, whereby said liquid furnishing means in combination with the liquid application cylinder will form a zone dyeing or coloring station.

14. Printing machine according to claim 11, further including an ink drying and setting liquid in said liquid furnishing means whereby the liquid furnishing means in combination with the liquid application cylinder (14) will form an ink smear prevention station.

15. Printing machine according to claim 14, wherein said liquid in the liquid furnishing means comprises at least one of the liquids of the group consisting of: kerosene; a volatile hydrocarbon other than kerosene; an aqueous alcohol solution.

* * * * *